US012383069B2

(12) United States Patent
McLeod

(10) Patent No.: US 12,383,069 B2
(45) Date of Patent: Aug. 12, 2025

(54) RAIN CURTAIN HEADBOARD

(71) Applicant: Joseph McLeod, Cambridge (CA)

(72) Inventor: Joseph McLeod, Cambridge (CA)

( * ) Notice: Subject to any disclaimer, the term of this patent is extended or adjusted under 35 U.S.C. 154(b) by 864 days.

(21) Appl. No.: 17/528,680

(22) Filed: Nov. 17, 2021

(65) Prior Publication Data

US 2023/0148759 A1 May 18, 2023

(51) Int. Cl.
*A47C 21/00* (2006.01)
*A47C 19/02* (2006.01)
*A47C 31/00* (2006.01)

(52) U.S. Cl.
CPC ..... *A47C 21/003* (2013.01); *A47C 19/022* (2013.01); *A47C 31/008* (2013.01)

(58) Field of Classification Search
CPC ... A47C 19/022; A47C 21/003; A47C 31/008; B05B 17/08; B05B 17/085
See application file for complete search history.

(56) References Cited

U.S. PATENT DOCUMENTS 4,352,149 A * 9/1982 Stetler ..... B44F 9/00 239/18
D398,422 S * 9/1998 Rooks ..... D6/718.14
6,085,988 A * 7/2000 Marsh ..... B05B 1/3402 239/524
6,279,835 B1 * 8/2001 Hansen ..... B05B 17/085 40/406
7,861,942 B2 * 1/2011 Damon ..... B05B 17/085 239/18
8,225,539 B2 * 7/2012 Beebe ..... G09F 13/22 40/406
10,314,407 B1 6/2019 Main et al.
2004/0112977 A1 * 6/2004 Fisher ..... B05B 17/085 239/17
2010/0005588 A1 1/2010 Christopher
2018/0110960 A1 4/2018 Youngblood et al.
2018/0160819 A1 6/2018 Rutledge
2018/0214902 A1 * 8/2018 Focaccia ..... B05B 1/20
2019/0183254 A1 6/2019 Blackett
2022/0212221 A1 * 7/2022 Cacoub ..... B05B 1/20
2023/0158414 A1 * 5/2023 Molenaar ..... B05B 17/08 472/128
2024/0138578 A1 * 5/2024 Washington ..... A47C 19/22

FOREIGN PATENT DOCUMENTS

KR 20160094711 A * 2/2015 ..... A01G 31/02
KR 20180003077 A * 6/2016 ..... A01G 7/045

* cited by examiner

*Primary Examiner* — Justin C Mikowski
*Assistant Examiner* — Alison N Labarge
(74) *Attorney, Agent, or Firm* — Mark A. McCormick

(57) ABSTRACT

The present invention is directed to a rain curtain headboard. The invention includes a headboard, a rain system, a light bar, and a viewing window. The headboard includes a cavity housing the rain system. The rain system creates a rain curtain, viewable through the viewing window, that is adapted to soothe a user using sound therapy, humidity, aromatherapy, or combinations thereof.

15 Claims, 4 Drawing Sheets

RAIN CURTAIN HEADBOARD

FIELD OF THE INVENTION

This invention relates to sleep systems and accessories. More particularly, it relates to a rain curtain headboard for providing an improved sleep environment.

BACKGROUND

Sleep plays an essential role in a person's health and well-being throughout life. For example, sleep deficiency has been linked to a variety of serious chronic health problems, including increased risk of heart disease, high blood pressure, obesity, diabetes, kidney disease, and stroke. In addition to physical health, getting enough quality sleep is also important for one's emotional health. Insufficient or poor-quality sleep has been shown to negatively impact a person's happiness and quality of life and can also contribute to depression and other mood disorders. Sleep deprivation can also impair brain function and reaction time, which can lead to performance issues at work or school and can have more severe consequences such as causing car accidents. It is therefore important for a person to get enough quality sleep each night.

The sleeping area is central to a good night's rest. While poor-quality sleep can be linked to many different causes, there are several known environmental factors that can affect sleep quality. Important environmental factors may include, for example, noise levels, lighting, temperature, humidity, and ventilation. Depending on the person, too much or too little noise, light, temperature, air flow, and humidity may make it difficult to fall and remain asleep. While preferred sleeping environments can vary significantly from person to person, if one or more of the above environmental factors falls outside a person's preferred range, that person may suffer from poor sleep and the negative health consequences that come with it.

Accordingly, and in light of the foregoing, it would be desirable for a device that provides an enhanced sleeping environment with respect to the user's senses and relaxation levels.

DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
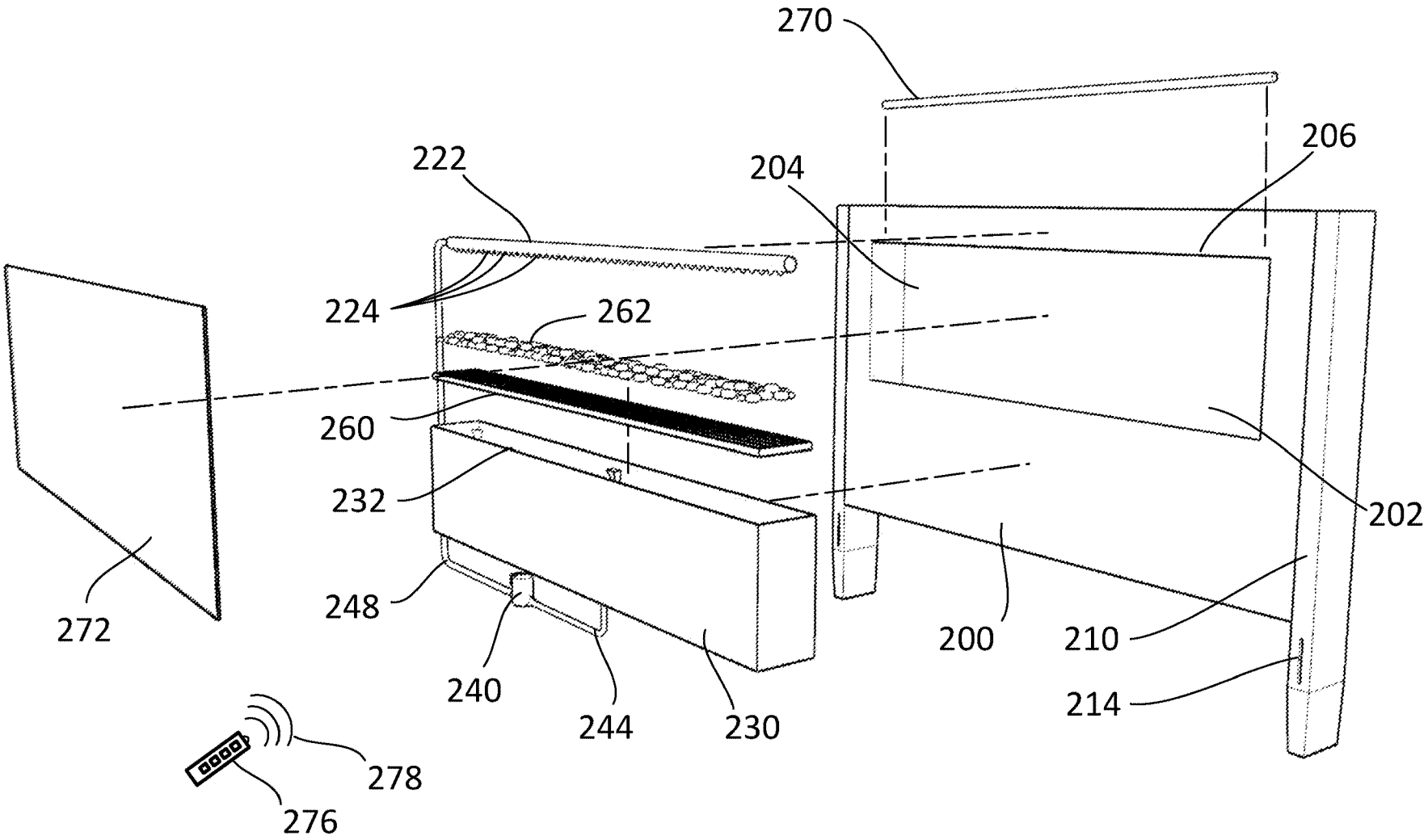
FIG. 1 is an exploded view of a rain curtain headboard 100, according to an embodiment of the present invention.
Figure 2:
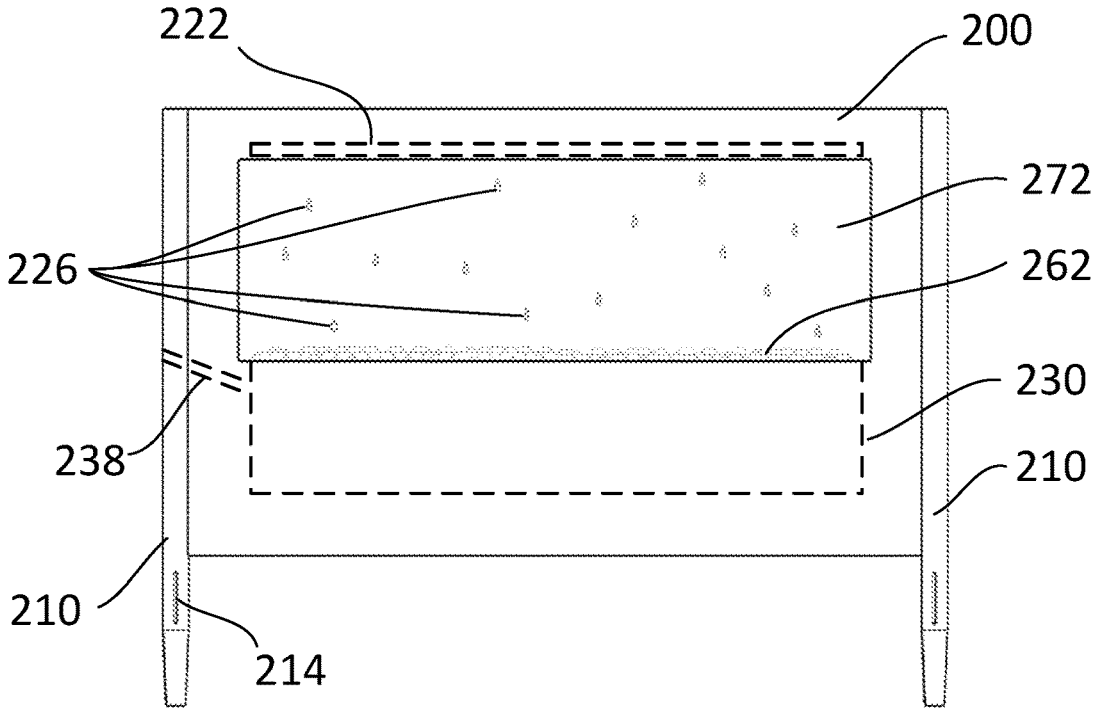
FIG. 2 is a front view of a rain curtain headboard 100, according to an embodiment of the present invention; and, FIG. 3 is a side view of a rain curtain headboard 100, according to an embodiment of the present invention; and, FIG. 4 is a detail view of a rain curtain headboard 100, according to an embodiment of the present invention illustrating attachment of bed rails; and, FIG. 5 is an exploded detail view of a rain curtain headboard 100, according to an embodiment of the present invention illustrating the rain system.
Figure 3:
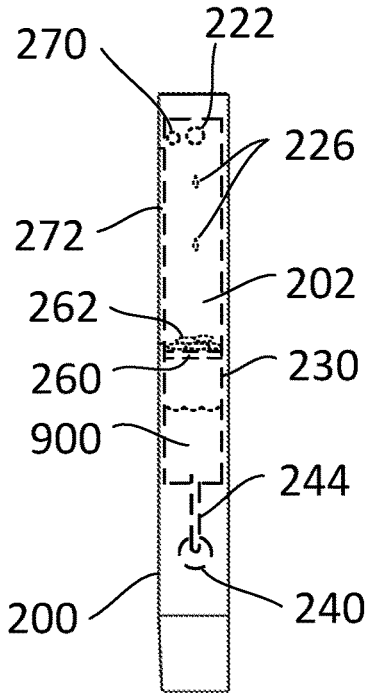
Figure 4:
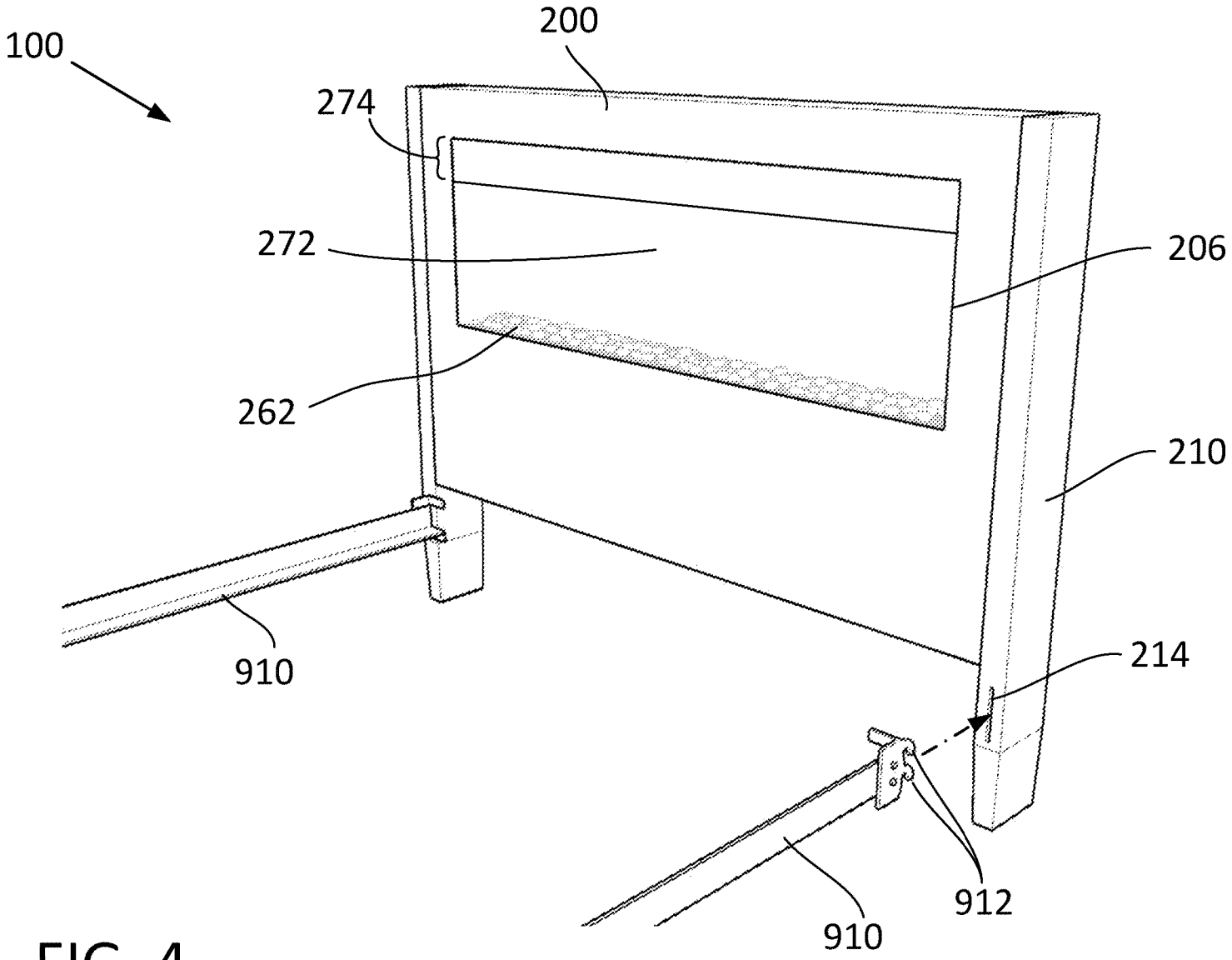
Figure 5:
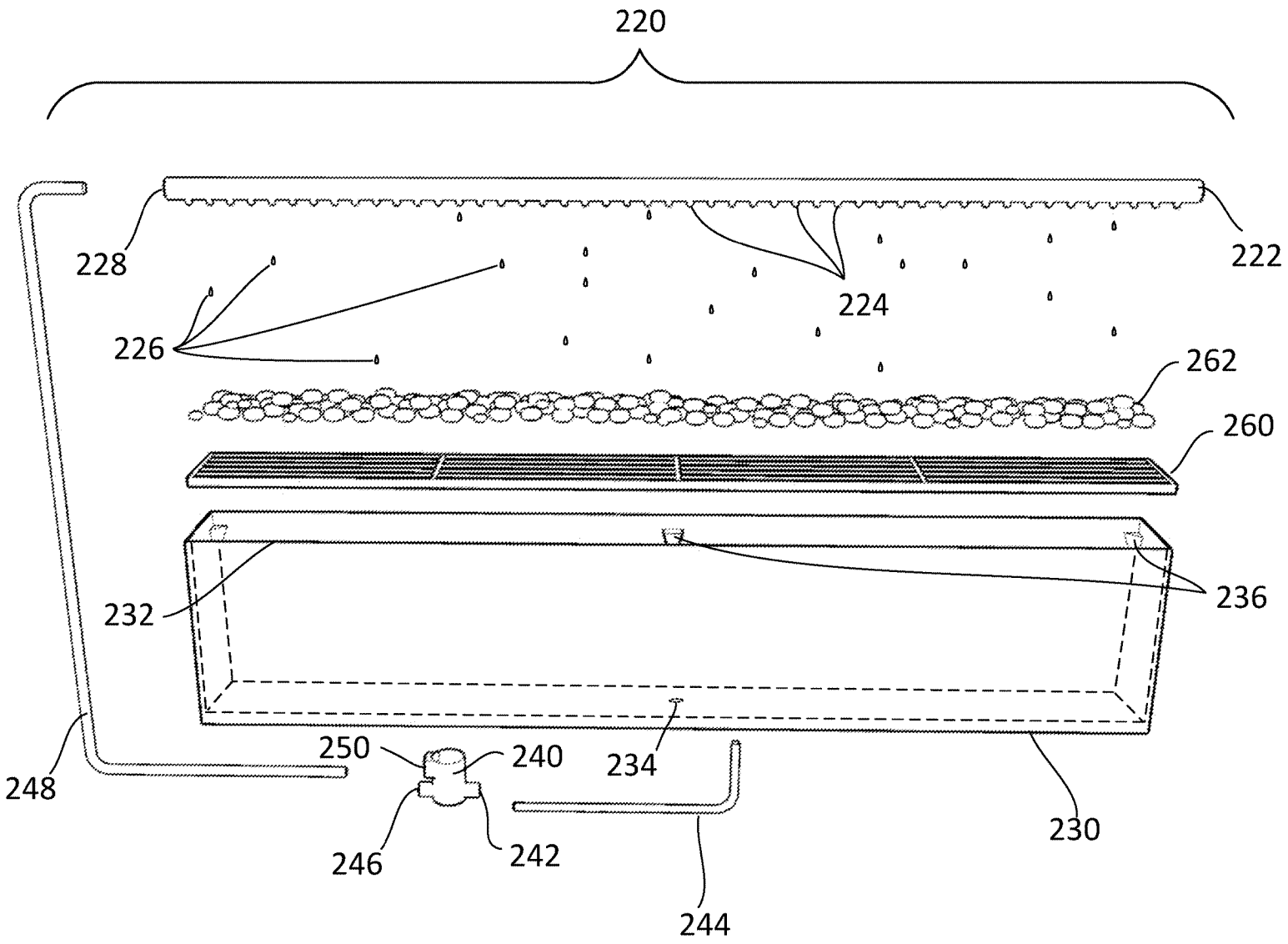

100 rain curtain headboard
200 headboard

202 cavity
204 back wall
206 viewing aperture
210 leg
214 bed rail slot
220 rain system
222 rain effect discharge tube
224 nozzle
226 simulated raindrop
228 discharge tube inlet
230 water trough
232 top aperture
234 outlet tubing aperture
236 grate support
238 refill access
240 pump
242 pump intake
244 intake tubing
246 pump outlet
248 outlet tubing
250 controller
260 grate
262 splash target
270 light bar
272 viewing window
274 gap
276 remote control
278 wireless signal
900 water
910 bed rail
912 bed rail connecting hook

DETAILED DESCRIPTION OF THE INVENTION

The present invention is directed to a rain curtain headboard (herein described as the "invention") 100. The present invention may also be used as a footboard. The invention 100 may comprise a headboard 200, a rain system 220, a light bar 270, and a viewing window 272. The headboard 200 may be a structural element of a bed frame. The headboard 200 may comprise a cavity 202 housing the rain system 220. The rain system 220 may create a rain curtain, viewable through the viewing window 272, that is adapted to soothe a user using sound therapy, humidity, aromatherapy, or combinations thereof. The light bar 270 may provide illumination for viewing items located within the cavity 202 including, but not limited to, the rain curtain.

The headboard 200 may be a vertically-oriented panel located at the head-end of a bed. The headboard 200 may be adapted to couple to bed rails 910 in order to support, in conjunction with other elements of the bed frame, a mattress. The headboard 200 may comprise the cavity 202 for housing the rain system 220. The headboard 200 may comprise a viewing aperture 206. The viewing aperture 206 may be an opening in the front of the headboard 200 that provides visual access to the rain system 220 located inside of the cavity 202. The viewing window 272 may be watertight by covering the viewing aperture 206 to prevent water 900 from splashing out of the cavity 202.

The headboard 200 may comprise a pair of legs 210 that elevate the headboard 200. An individual leg selected from the pair of legs 210 may comprise a bed rail slot 214 located on the lower front of the individual leg. The bed rail slot 214 may provide an attachment point for bed rail connecting hooks 912.

The headboard 200 may be made of wood, plastic, metal, or combinations thereof. In some embodiments, the headboard 200 may comprise padded material. In some embodiments, the headboard 200 may comprise one (1) or more bookshelves, reading lights, drawers, and/or other features commonly found on some headboards.

The rain system 220 may comprise a rain effect discharge tube 222, a water trough 230, a pump 240, a controller 250, and a grate 260. The rain system 220 may create the rain curtain by pumping the water 900 from the water trough 230 to the rain effect discharge tube 222 and allowing the water 900 to fall from the rain effect discharge tube 222 back into the water trough 230 as simulated raindrops 226. The simulated raindrops 226 may strike a plurality of splash targets 262 resting on the grate 260 at the top of the water trough 230. The simulated raindrops 226 may create a sound as the simulated raindrops 226 strike the plurality of splash targets 262. The sound may be adapted to be soothing.

The rain effect discharge tube 222 may comprise a plurality of nozzles 224 and a discharge tube inlet 228. The rain effect discharge tube 222 may be a horizontally-oriented conduit that is located at the top center of the cavity 202. As non-limiting example, the rain effect discharge tube 222 may be made from PVC, Stainless, Aluminum, or copper pipe. The water 900 may be pumped into the rain effect discharge tube 222 via the discharge tube inlet 228 and may flow out of the rain effect discharge tube 222 via the plurality of nozzles 224.

The plurality of nozzles 224 may be a plurality of apertures that promote creation of the simulated raindrops 226. The plurality of nozzles 224 may be linearly aligned and evenly spaced along the bottom of the rain effect discharge tube 222. As non-limiting examples, the plurality of nozzles 224 may be as simple as holes drilled into the bottom of the rain effect discharge tube 222 or the plurality of nozzles 224 may comprise replaceable fixtures that screw into the bottom of the rain effect discharge tube 222. In some embodiments, the plurality of nozzles 224 may be of uniform diameter such that the simulated raindrops 226 form at a uniform rate and/or size. In some embodiments, the diameter of the plurality of nozzles 224 may intentionally be varied such that the simulated raindrops 226 form at a non-uniform rate and/or size, thus imitating a random rainfall pattern. As the simulated raindrops 226 form at the plurality of nozzles 224, the simulated raindrops 226 may fall from the rain effect discharge tube 222 towards the water trough 230.

The water trough 230 may be a container for holding the water 900. The top of the water trough 230 may be open to form a top aperture 232 where the water 900 may reenter the water trough 230 after falling as the simulated raindrops 226. An outlet tubing aperture 234 located at the bottom of the water trough 230 may allow the water 900 to exit the water trough 230. The outlet tubing aperture 234 may be located in the bottom wall of the water trough 230 if the pump 240 is located below the water trough 230. In some embodiments, the pump 240 may be submersed in the water 900 in the water trough 230 and the outlet tubing aperture 234 may be located in a side wall of the water trough 230.

In some embodiments, the headboard 200 may comprise a refill access 238 to provide access for refilling the water trough 230. The refill access 238 may be operable to accept refill water and channel the refill water into the water trough 230. The refill access 238 may be accessible on the left side of the headboard 200, on the right side of the headboard 200, on the front of the headboard 200, on the rear of the headboard 200, or combinations thereof. As a non-limiting example, the refill access 238 may be hidden behind a decorative emblem or door.

The water 900 may arrive at a pump intake 242 via an intake tubing 244 if the pump intake 242 is located below the water trough 230 or the water 900 may flow directly into the pump 240 if the pump 240 is a submersible pump located in the water trough 230. The pump 240 may move the water 900 from the pump intake 242 to a pump outlet 246. The pump 240 may be electromechanical and may comprise an internal motor that may be energized by the application of an electrical potential to the pump 240. As non-limiting examples, the pump 240 may move the water 900 by applying rotary motion, reciprocating motion, linear motion, or a combination thereof to one or more gears, screws, pistons, shuttle blocks, vanes, diaphragms, plungers, chains, ropes, impellers, or combinations thereof. Because the pump 240 is applied with the bed, the pump 240 may be selected to meet specific acoustic noise requirements. An outlet tubing 248 may carry the water 900 from the pump outlet 246 to the rain effect discharge tube 222. In some embodiments, the pump 240 may be submersible and may be placed in the water 900 at the bottom of the water trough 230. In such embodiments, the outlet tubing 248 may pass through a wall or the bottom of the water trough 230 to reach the rain effect discharge tube 222. The pump intake 242 may comprise the intake tubing 244. The pump outlet 246 may comprise the outlet tubing 248.

The controller 250 may determine when the electrical potential is to be applied to the pump 240. The controller 250 may base decisions to energize the pump 240 on commands from wireless signals 278 received from a remote control 276, on internal timers, or both. In some embodiments, the controller 250 may determine not only the on/off cycles of the pump 240 but also the volume of water moved by the pump 240. As a non-limiting example, the controller 250 may control a voltage level of the electrical potential, a current level, a frequency of the electrical potential, a phase of the electrical potential, or combinations thereof to affect the volume of water pumped.

The grate 260 may be removably coupled to the top of the water trough 230. The grate 260 may rest upon a plurality of grate supports 236 located within the water trough 230. The plurality of splash targets 262 may be placed on the grate 260 such that the simulated raindrops 226 may strike the plurality of splash targets 262 as the simulated raindrops 226 fall.

The plurality of splash targets 262 may be selected for acoustic properties, appearance, or both. As non-limiting examples, the plurality of splash targets 262 may be stones, vase filler glass, landscape glass, bells, or metal plates. The plurality of splash targets 262 may be selected such that the plurality of splash targets 262 may make a distinct acoustic tone when struck by the simulated raindrop 226 or because they have a pleasing appearance.

The light bar 270 may illuminate the interior of the cavity 202. The light bar 270 may be energized and controlled by the controller 250. The controller 250 may determine the brightness and hue of the light bar 270.

The viewing window 272 may be a transparent barrier between the rain curtain and the user to prevent the water 900 from splashing into the bed. As non-limiting examples, the viewing window 272 may be made from glass or clear acrylic plastic. In some embodiments, the viewing window 272 may comprise a gap 274 at the top of the viewing aperture 206 such that sound and moist air may pass from within the cavity 202. In some embodiments, the viewing window 272 may be translucent.

The remote control 276 may be adapted to permit the user to control any or all of these operational parameters of the invention 100: pump on/off state, pump water volume, light bar on/off state, light bar brightness, light bar hue (color). The remote control 276 may be adapted to communicate user selections of the operational parameters to the controller 250 via the wireless signal 278. In some embodiments, a smartphone may be used to control the controller 250 in place of or in addition to the remote control 276. As a non-limiting example, the smartphone may communicate with the controller 250 via Bluetooth® protocols.

In some embodiments, the headboard 200 may comprise a decorative effect located on a back wall 204 of the cavity 202. As non-limiting examples, the decorative effect may be an image such as soothing photograph or drawing or the decorative effect may comprise a texture such as a stone veneer.

In some embodiments, the invention 100 may comprise the use of water additives to prevent mildew, to add a scent to the water 900, or both. As a non-limiting example, the water additives may comprise antifungal additives and/or antibacterial additives to prevent mildew and other biological contaminants. As a non-limiting example, the water additives may comprise scented oils to promote aromatherapy.

Although the headboard 200 has been described as coupling to the bed rails 910 using the bed rail connecting hooks 912, it should be noted that the headboard 200 may be coupled to bolt-style bed rails by using an adapter between the bed rails 910 and the bed rail slots 214 on the headboard 200. As a non-limiting example, the adapter may be a #711 Bolt-On to Hook-On Conversion Bed Frame Bracket.

In use, the bed rails 910 and the rest of the bed frames may be coupled to the headboard 200 and the mattress, bed sheets, comforters, and pillows may be placed on the bed frame. Water 900 may be added to the water trough 230. The user may energize the pump 240 using the remote control 276 or the smartphone. The water 900 may be pumped into the rain effect discharge tube 222 and may fall from the plurality of nozzles 224 as the simulated raindrops 226. The simulated raindrops 226 may create pleasing sounds as the simulated raindrops 226 fall onto the plurality of splash targets 262 creating a sound of falling rain as the simulated raindrops return to the trough. The user may control the speed of the pump 240 to increase or decrease the rate of production of the simulated raindrops 226. The user may establish a desired lighting effect by using the remote control 276 or the smartphone to adjust the on/off state, intensity, and hue of the light bar 270.

The steps involved in creating the sound of falling rain from a bed headboard includes fabricating a cavity in the headboard, mounting a rain discharge tube in the cavity, placing a plurality of splash targets under the rain discharge tube, covering the cavity with a transparent or translucent cover, circulating water from a trough through the rain discharge tube, and onto at least some of the splash targets, and illuminating the cavity with a light bar.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A headboard for a bed consisting of:

a panel constructed to be located at a bed head-end; the panel comprising:

a cavity located in a portion of the panel visible from the bed;

a rain system mounted inside the cavity, wherein the rain system having:

a pump;

a water trough;

a rain effect discharge tube mounted in the cavity;

a plurality of splash targets mounted below the discharge tube; and wherein, the pump is configured to pump water from the trough through the rain effect discharge tube to create simulated raindrops; and wherein, the simulated raindrops strike at least some of the plurality of splash targets creating a sound of falling rain as the simulated raindrops return to the trough; a controller, the controller configured to control the pump;

a light bar constructed to illuminate said cavity, the light bar configured to be controlled by the controller, the controller adapted to control either brightness or hue of the light bar; and a transparent or translucent water-tight viewing window attached to the panel covering the cavity.

2. The headboard of claim 1, wherein the rain system is constructed to create a rain curtain.

3. The headboard of claim 1, wherein the rain effect discharge tube includes a plurality of nozzles.

4. The headboard of claim 3, wherein the plurality of nozzles are holes drilled into the rain effect discharge tube.

5. The headboard of claim 1, wherein the pump is mounted below the water trough.

6. The headboard of claim 1, wherein the pump is submersed in the water trough.

7. The headboard of claim 1, wherein the controller is configured to control on/off cycles of the pump.

8. The headboard of claim 1, wherein the controller is configured to control volume of water moved by the pump from the trough to the rain effect discharge tube.

9. The headboard of claim 1, wherein controller is configured to receive commands wirelessly from a remote-control unit or directly from an internal timer.

10. The headboard of claim 1, wherein at least some of the splash targets are selected from the group consisting of stones, vase filler glass, landscape class, bells and metal plates.

11. A headboard for a bed of the type having legs and attachment points to a bed frame, the headboard consisting of:

a panel constructed to be located at a bed head-end; the panel including:

a cavity located in a portion of the panel visible from the bed;

a pump;

a water trough;

a rain effect discharge tube mounted in the cavity;

a plurality of splash targets mounted below the discharge tube;

a transparent water-tight viewing window attached to the panel covering the cavity to allow viewing of the cavity from the bed; a controller; wherein, the pump is configured to pump water from the trough through the rain effect discharge tube to create simulated raindrops; and wherein, the simulated raindrops strike at least some of the plurality of splash targets creating a sound of falling rain as the simulated raindrops return to the trough and wherein a transparent water -tight viewing window attached to the panel covering the cavity.

12. The headboard of claim 11, wherein the controller is configured to control the pump, and wherein, the controller is configured to control on/off cycles of the pump to control volume of water moved by the pump from the trough to the rain effect discharge tube.

13. The headboard of claim 12, wherein controller is configured to receive commands wirelessly from a remote-control unit or directly from an internal timer.

14. The headboard of claim 11, wherein at least some of the splash targets are selected from the group consisting of stones, vase filler glass, landscape class, bells and metal plates.

15. A method of creating a sound of falling rain from a bed headboard consisting of:

fabricating a cavity in the headboard, wherein a light bar illuminates said cavity;

mounting a rain discharge tube in the cavity;

placing a plurality of splash targets under the rain discharge tube;

covering the cavity with a transparent or translucent cover;

circulating water from a trough through the rain discharge tube, and onto at least some of the splash targets.

* * * * *